US010384915B2

(12) United States Patent
Yamaura et al.

(10) Patent No.: US 10,384,915 B2
(45) Date of Patent: Aug. 20, 2019

(54) PIVOTING DEVICE

(71) Applicants: TADANO LTD., Kagawa (JP); Hiroshi Yamaura, Tokyo (JP)

(72) Inventors: Hiroshi Yamaura, Tokyo (JP); Kazuya Tanizumi, Kagawa (JP); Shinji Noguchi, Kagawa (JP); Yuji Tadano, Kagawa (JP)

(73) Assignees: TADANO LTD., Kagawa (JP); HIROSHI YAMAURA, Tokyo (JP)

( * ) Notice: Subject to any disclaimer, the term of this patent is extended or adjusted under 35 U.S.C. 154(b) by 107 days.

(21) Appl. No.: 15/558,695

(22) PCT Filed: Mar. 17, 2016

(86) PCT No.: PCT/JP2016/058510
§ 371 (c)(1),
(2) Date: Sep. 15, 2017

(87) PCT Pub. No.: WO2016/148241
PCT Pub. Date: Sep. 22, 2016

(65) Prior Publication Data

US 2018/0111803 A1 Apr. 26, 2018

(30) Foreign Application Priority Data

Mar. 19, 2015 (JP) ..... 2015-055753

(51) Int. Cl.
*B66C 13/18* (2006.01)
*B66C 23/00* (2006.01)
(Continued)

(52) U.S. Cl.
CPC ..... *B66C 13/18* (2013.01); *B66C 23/00* (2013.01); *B66C 23/701* (2013.01); *B66C 23/84* (2013.01)

(58) Field of Classification Search
None
See application file for complete search history.

(56) References Cited

U.S. PATENT DOCUMENTS 5,908,122 A * 6/1999 Robinett ..... B66C 13/063 212/225

FOREIGN PATENT DOCUMENTS

JP 03036193 A * 2/1991
JP 05139689 A * 6/1993
(Continued)

OTHER PUBLICATIONS

K. Yano, M. Yamada and K. Terashima, "Development of Operator Support System for Rotary Crane with Simultaneous Control of Positioning and Sway Suppression," 2007 IEEE International Conference on Control Applications, Singapore, 2007, pp. 551-556. (Year: 2007).*

*Primary Examiner* — Christian Chace
*Assistant Examiner* — Katherine Marie Fitzharris
(74) *Attorney, Agent, or Firm* — Paratus Law Group, PLLC

(57) ABSTRACT

A slewing apparatus includes a control section that performs at least a slewing angular velocity pattern determination process. In the slewing angular velocity pattern determination process, the slewing angular velocity pattern is determined such that in a first interval and a second interval of a control time T that is shorter than a cycle determined by a pendulum length of a suspended load that is in a pendulum motion, a difference between a maximum angular velocity and a minimum angular velocity increases as the control time T decreases.

7 Claims, 12 Drawing Sheets

(51) Int. Cl.
*B66C 23/70* (2006.01)
*B66C 23/84* (2006.01)

(56) References Cited

FOREIGN PATENT DOCUMENTS

| | | | | |
|---|---|---|---|---|
| JP | 07-012906 | | | 2/1995 |
| JP | 2501995 | B2 | | 3/1996 |
| JP | 10059679 | A | * | 3/1998 |
| JP | 2001130865 | A | * | 5/2001 |

* cited by examiner

PIVOTING DEVICE

CROSS REFERENCE TO PRIOR APPLICATION

This application is a National Stage Patent Application of PCT International Patent Application No. PCT/JP2016/058510 (filed on Mar. 17, 2016) under 35 U.S.C. § 371, which claims priority to Japanese Patent Application No. 2015-055753 (filed on Mar. 19, 2015), which are all hereby incorporated by reference in their entirety.

TECHNICAL FIELD

The present invention relates to a slewing apparatus that slews with a suspended load suspended from the tip of a boom.

BACKGROUND ART

In a slewing apparatus that slews with a suspended load suspended from the tip of a boom, a technology of suppressing swing of the suspended load after the slewing has been known. For example, Patent Literature (hereinafter, abbreviated as PTL) 1 discloses that swing of a suspended load is suppressed by setting an acceleration interval and a deceleration interval of slewing to a time that is an integral multiple of the swing cycle of a suspended load that is in a pendulum motion. PTL 2 discloses that swing of a suspended load is suppressed by allowing each of an acceleration interval and a deceleration interval to include a constant velocity interval.

CITATION LIST

Patent Literature

PTL 1
Japanese Patent No. 2501995
PTL 2
Japanese Examined Patent Application Publication No. 7-12906

SUMMARY OF INVENTION

Technical Problem

However, in the technologies of PTLs 1 and 2, it is necessary to set an acceleration interval and a deceleration interval equal to or longer than the swing cycle of a suspended load. This brings a problem that it is difficult to shorten the slewing time from the slewing start position to the slewing end position.

The present invention has been made in view of the aforementioned situation. An object of the present invention is to provide a slewing apparatus capable of reducing the slewing time while suppressing swing of a suspended load at the slewing end position.

Solution to Problem (1) A slewing apparatus according the present invention includes: a base; a slewing body slewably supported by the base; a boom supported by a slewing base in a derricking and telescopic manner; a hook suspended by a rope from a tip portion of the boom; a slewing actuator that allows the slewing body to slew; and a control section that controls the slewing actuator, in which the control section performs: an acquisition process of acquiring a slewing start position and a slewing end position of the slewing body, and a pendulum length that is a length from the tip portion of the boom to a suspended load suspended from the hook; a slewing angular velocity pattern determination process of determining a slewing angular velocity pattern by optimum control in a first interval and a second interval, the slewing angular velocity pattern indicating transition of an angular velocity of the tip portion of the boom when the slewing body slews from the slewing start position to the slewing end position, the first interval being an interval in which the angular velocity is accelerated from the slewing start position, and decelerated, and accelerated to be a slewing angular velocity $\omega$, the second interval being an interval in which the angular velocity is decelerated from the slewing angular velocity $\omega$, and accelerated, and decelerated to be stopped at the slewing end position; and an actuator control process of controlling the slewing actuator to allow the slewing body to slew from the slewing start position to the slewing end position such that the tip portion of the boom moves in a slewing direction at a velocity indicated by the slewing angular velocity pattern, and in the slewing angular velocity pattern determination process, the slewing angular velocity pattern is determined such that in the first interval and the second interval of a control time T that is shorter than a cycle determined by the pendulum length of the suspended load that is in a pendulum motion, a difference between a maximum angular velocity and a minimum angular velocity increases as the control time T decreases.

With the configuration described above, swing in the slewing direction of the suspended load at the slewing end position can be suppressed. Further, first interval and the second interval can be shorter than a cycle $T_0$ of the suspended load that is in a pendulum motion. Consequently, the slewing time from the slewing start position to the slewing end position can be reduced compared with that in the conventional method.

(2) Preferably, in the slewing angular velocity pattern determination process, the control section determines the slewing angular velocity pattern in which the control time T is shortest within a range of response performance of the slewing actuator.

With the configuration described above, the slewing time can be further reduced within the range of the response performance of the slewing actuator.

(3) For example, in the slewing angular velocity pattern determination process, the control section determines an angular velocity x'(t) of the tip portion of the boom after t second from start of slewing by specifying a coefficient $a_i$ ($i=1, \ldots, 5$) of equation 7 satisfying an initial condition and a terminal condition of the first interval.

(4) Preferably, the slewing apparatus further includes: a derricking actuator that derricks the boom under control of the control section; and a telescopic actuator that telescopes the boom under control of the control section; in which the control section further performs a radial velocity pattern determination process of determining a radial velocity pattern, the radial velocity pattern indicating transition of a moving velocity of the tip end portion of the boom in a slewing radial direction when the slewing body slews from the slewing start position to the slewing end position, wherein in the radial velocity pattern, the slewing radius is increased and decreased in the first interval and the second interval, in the acquisition process, the control section further acquires a slewing radius r, the slewing radius r being a horizontal distance between center of slewing of the slewing body and the tip portion of the boom at the slewing start position, in the radial velocity pattern determination process, the control section determines the radial velocity pattern in which forces in the slewing radial direction acted on the suspended load at a position of the slewing radius r at end of the first interval and at end of the second interval are balanced, and in the actuator control process, the control section controls the derricking actuator and/or telescopic actuator to allow the boom to be derricked and/or telescoped such that the tip portion of the boom moves in the slewing radial direction at a velocity indicated by the radial velocity pattern.

With the configuration described above, swing in the slewing radial direction of the suspended load at the slewing end position can be suppressed.

(5) For example, in the radial velocity pattern determination process, the control section determines the radial velocity pattern in which the suspended load moves on the slewing radius r when the slewing body slews from the slewing start position to the slewing end position.

(6) As an example, in the radial velocity pattern determination process, the control section determines a moving velocity $R_0'(t)$ in the slewing radial direction of the tip portion of the boom after t second from start of slewing by specifying a coefficient $r_i$(i=0, . . . , 5) of equation 12 satisfying an initial condition and a terminal condition of the first interval.

(7) As another example, in the radial velocity pattern determination process, the control section determines a moving velocity $R_0'(t)$ in the slewing radial direction of the tip portion of the boom after t second from start of slewing by specifying a coefficient $b_i$ (i=1, . . . , 5) of equation 19 satisfying an initial condition and a terminal condition of the first interval.

Advantageous Effects of Invention

According to the present invention, it is possible to suppress swing in the slewing direction of the suspended load at the slewing end position, and to reduce the slewing time from the slewing start position to the slewing end position.

BRIEF DESCRIPTION OF DRAWINGS

FIGS. 10A and 10B illustrate movement of suspended load 40 in the slewing control process, in which FIG. 10A illustrates the swing angle and the swing velocity in the slewing radial direction, and FIG. 10B illustrates the swing angle and the swing velocity in the slewing direction;

DESCRIPTION OF EMBODIMENTS

Hereinafter, a preferred embodiment of the present invention will be described with reference to the accompanying drawings as appropriate. It should be noted that the present embodiment is merely an aspect of the present invention, and it is needless to say that the embodiment may be changed without changing the scope of the present invention.

Rough Terrain Crane 101

Figure 1:
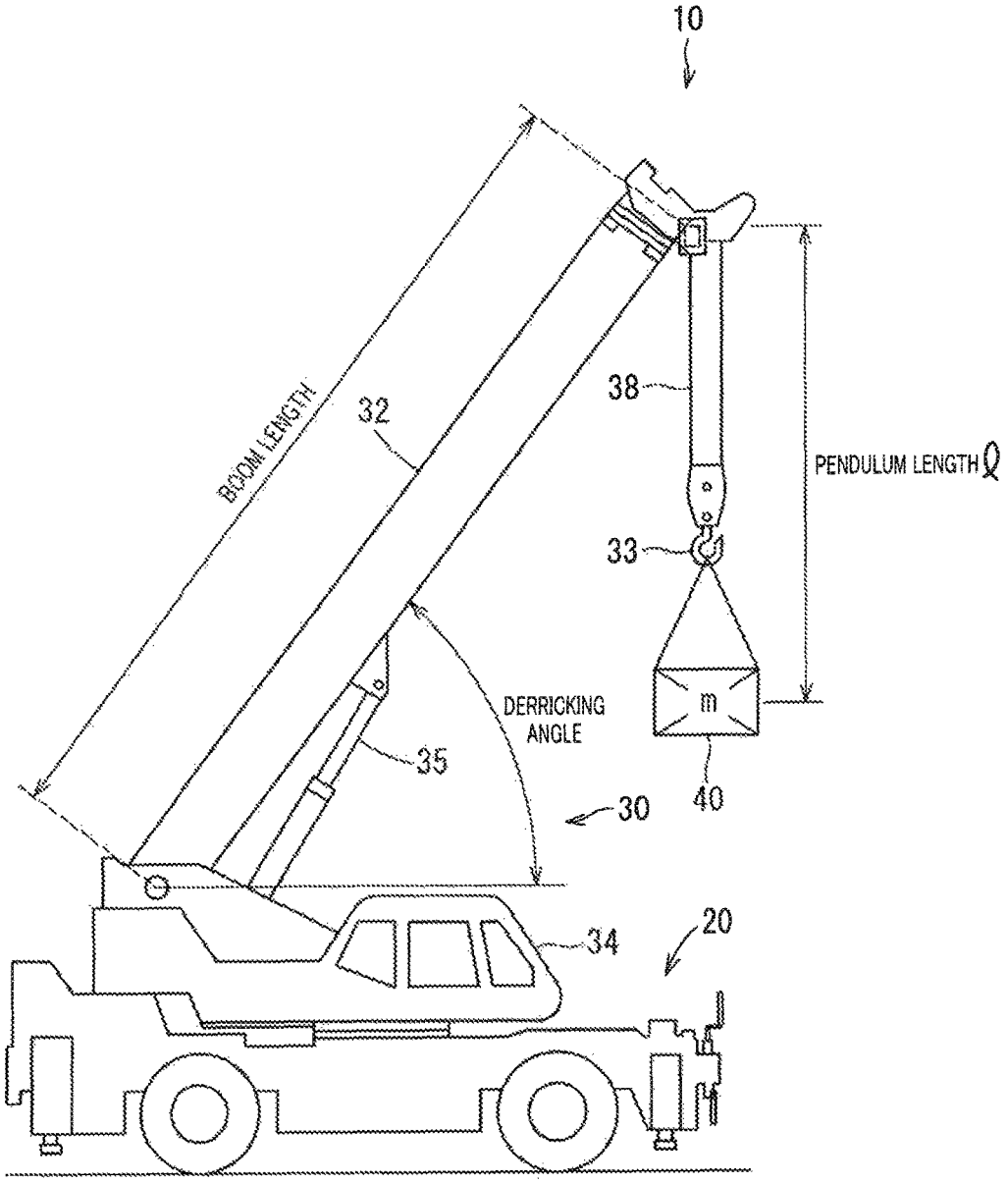
FIG. 1 is a schematic diagram of a rough terrain crane 10 according to the present embodiment.

As illustrated in FIG. 1, rough terrain crane 10 according to the present embodiment mainly includes lower traveling body 20 and upper working body 30. Lower traveling body 20 is able to travel to a destination on tires that are rotated by the driving force of an engine (not illustrated) transmitted thereto. Upper working body 30 is slewably supported by lower traveling body 20 via a slewing bearing (not illustrated). Upper working body 30 is allowed to slew relative to lower traveling body 20 by slewing motor 31 (see FIG. 2). Lower traveling body 20 is an example of a base. Upper working body 30 is an example of a slewing body. Slewing motor 31 is an example of a slewing actuator.

Upper working body 30 mainly includes telescopic boom 32, hook 33, and cabin 34. Telescopic boom 32 is derricked by derricking cylinder 35, and is telescoped by telescopic cylinder 36 (see FIG. 2). Hook 33 is suspended by rope 38 extending downward from the tip portion of telescopic boom 32 (hereinafter referred to as "boom tip portion"). Hook 33 is lifted when rope 38 is wound up by winch 39 (see FIG. 2), and is lowered when rope 38 is delivered. Cabin 34 has operation section 56 (see FIG. 2) for operating lower traveling body 20 and upper working body 30.

Derricking cylinder 35 is an example of a derricking actuator. Telescopic cylinder 36 is an example of a telescopic actuator. Upper working body 30 capable of slewing relative to lower traveling body 20, slewing motor 31 allowing upper working body 30 to slew, or a slewing reduction gear not illustrated is an example of a slewing apparatus. A specific example of a slewing apparatus is not limited to rough terrain crane 10, and may be an all terrain crane, a cargo crane, or the like. Further, a base is not necessarily movable. In that case, a slewing apparatus may be a tower crane, a slewing overhead crane, or the like.

Figure 2:
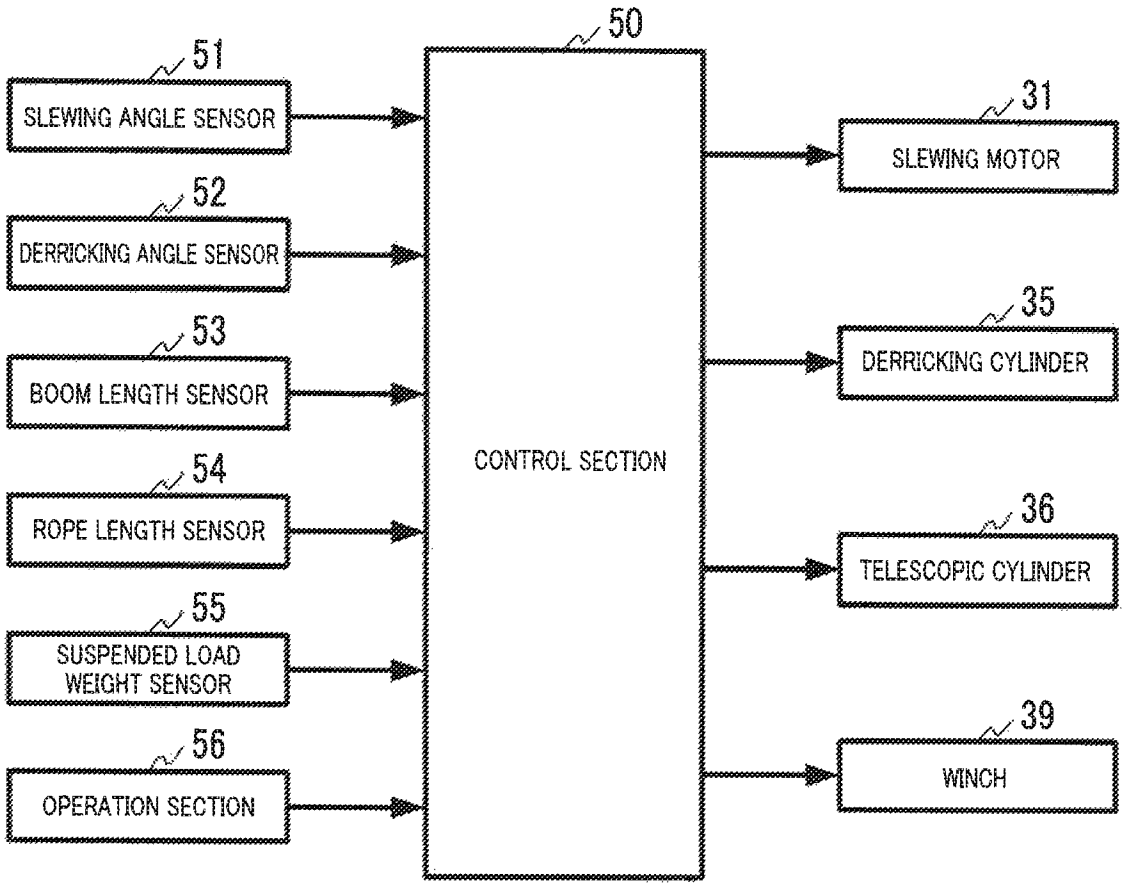
FIG. 2 is a functional block diagram of the rough terrain crane 10.
Figure 3:
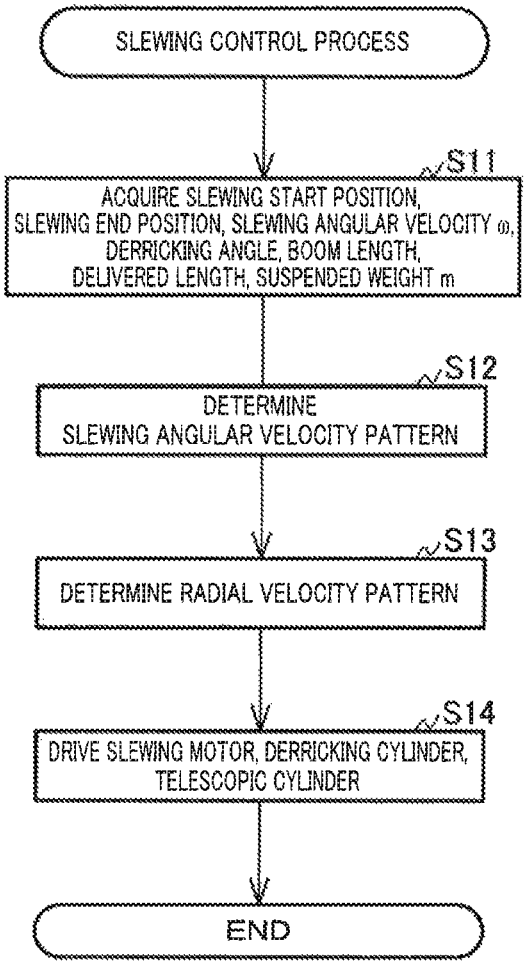
FIG. 3 is a flowchart of a slewing control process.
Figure 4:
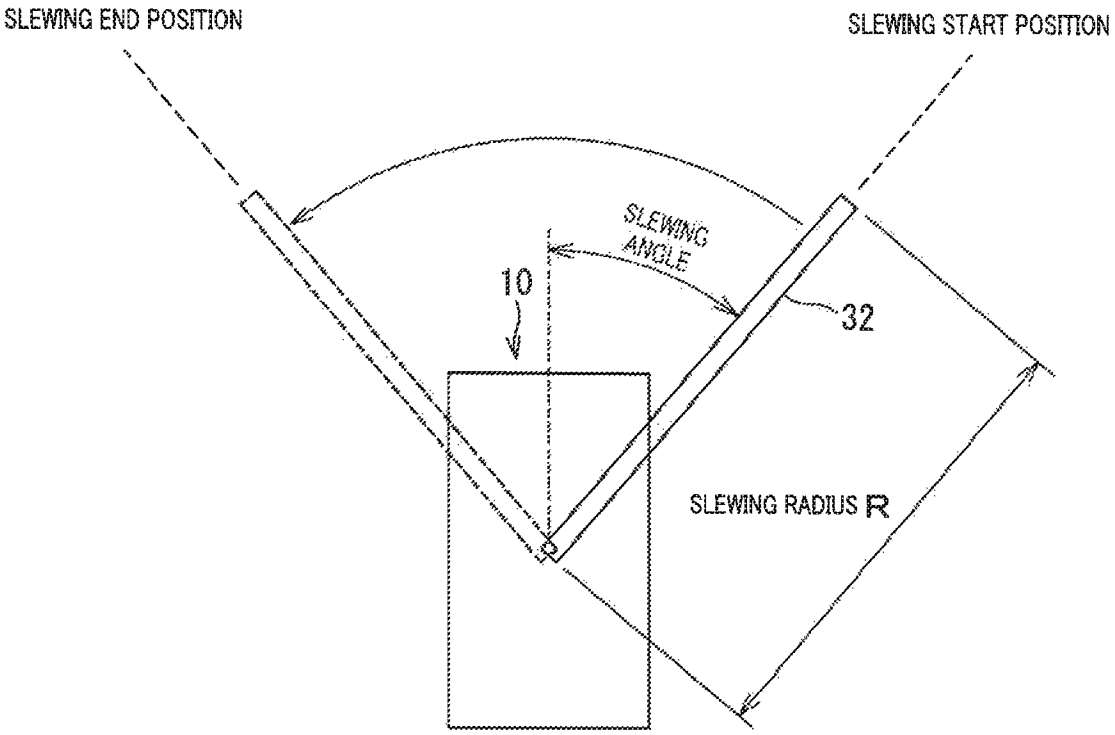
FIG. 4 is a schematic plan view of the rough terrain crane 10.

As illustrated in FIG. 2, rough terrain crane 10 includes control section 50. Control section 50 controls operation of rough terrain crane 10. Control section 50 may be implemented by a CPU (Central Processing Unit) that executes a program stored in a memory, or may be implemented by a hardware circuit, or by a combination thereof.

As illustrated in FIG. 2, control section 50 acquires various signals output from slewing angle sensor 51, derricking angle sensor 52, boom length sensor 53, rope length sensor 54, suspended load weight sensor 55, and operation section 56. Based on the acquired various signals, control section 50 controls slewing motor 31, derricking cylinder 35, telescopic cylinder 36, and winch 39.

Slewing angle sensor 51 outputs a detection signal corresponding to the slewing angle of upper working body 30

(for example, a clockwise angle where the advancing direction of lower traveling body 20 is set to be 0°). Derricking angle sensor 52 outputs a detection signal corresponding to the derricking angle of telescopic boom 32 (an angle defined by the horizontal direction and telescopic boom 32). Boom length sensor 53 outputs a detection signal corresponding to the length of telescopic boom 32 (hereinafter referred to as a "boom length"). Rope length sensor 54 outputs a detection signal corresponding to the length of the rope delivered from winch 39 (hereinafter referred to as a "delivered length"). Suspended load weight sensor 55 outputs a detection signal corresponding to the weight m (hereinafter referred to as "suspended weight m") of suspended load 40 suspended from hook 33. Strictly, the suspended weight m includes the weight of hook 33 and rope 38 extending from the boom tip portion.

Operation section 56 receives operation by a user for operating rough terrain crane 10. Then, operation section 56 outputs an operation signal corresponding to the received user operation. Specifically, control section 50 allows lower traveling body 20 to travel and allows upper working body 30 to operate based on the user operation received via operation section 56. Operation section 56 includes a lever, a steering, a pedal, an operation panel, and the like for operating rough terrain crane 10.

Operation section 56 of the present embodiment is also able to receive user operation to input a slewing end position of upper working body 30, a slewing angular velocity ω, and the like. Then, in the slewing control process described below, control section 50 allows upper working body 30 to slew, and allows telescopic boom 32 to be derricked and/or telescoped, according to a velocity pattern determined based on the input slewing end position, the slewing angular velocity ω, and the like.

Slewing motor 31, derricking cylinder 35, telescopic cylinder 36, and winch 39 of the present embodiment are hydraulic actuators. Specifically, control section 50 controls the direction and the flow rate of the hydraulic oil to be fed to thereby drive the respective actuators. However, the actuators of the present invention are not limited to hydraulic ones. They may be electric ones.

[Slewing Control Process]

Next, a slewing control process of the present embodiment will be described with reference to FIGS. 3 to 10B. The slewing control process is a process of slewing upper working body 30 from a slewing start position to a slewing end position according to a velocity pattern in which swing of suspended load 40 suspended from hook 33 at the slewing end position decreases. The slewing control process is performed by control section 50, for example.

[Acquisition Process]

First, control section 50 acquires the slewing start position, the slewing end position, the slewing angular velocity ω of upper working body 30, the derricking angle of telescopic boom 32, the boom length, the delivered length, and the suspended weight m, illustrated in FIGS. 1 to 4, via various sensors 51 to 55 and operation section 56 (S11). The process of step S11 is an example of an acquisition process.

The slewing start position is a current position of upper working body 30, for example. Specifically, control section 50 may acquire the slewing start position based on a detection signal output from slewing angle sensor 51. The slewing end position is a position of upper working body 30 after the slewing control process ends. The slewing angular velocity ω indicates a slewing angular velocity of upper working body 30 in a constant velocity interval described below. Control section 50 may acquire the slewing end position and the slewing angular velocity ω from the user via operation section 56. However, if an input of the slewing angular velocity ω is omitted, a preset default slewing angular velocity ω may be used.

Further, control section 50 calculates a slewing radius r at the slewing start position based on the derricking angle and the boom length. The slewing radius r indicates a horizontal distance between the slewing center of upper working body 30 and the boom tip portion, for example. The boom tip portion is a position of the center of rotation of a sheave for winding rope 38, for example. Control section 50 also calculates a pendulum length l that is a length from the boom tip portion to suspended load 40, based on the boom length and the delivered length. Control section 50 may calculate the pendulum length l by adding a predetermined constant corresponding to the length from hook 33 to the position of the center of gravity of suspended load 40, to the length between the boom tip portion and hook 33 calculated based on the boom length and the delivered length, for example.

[Slewing Angular Velocity Pattern Determination Process]

Figure 5A:
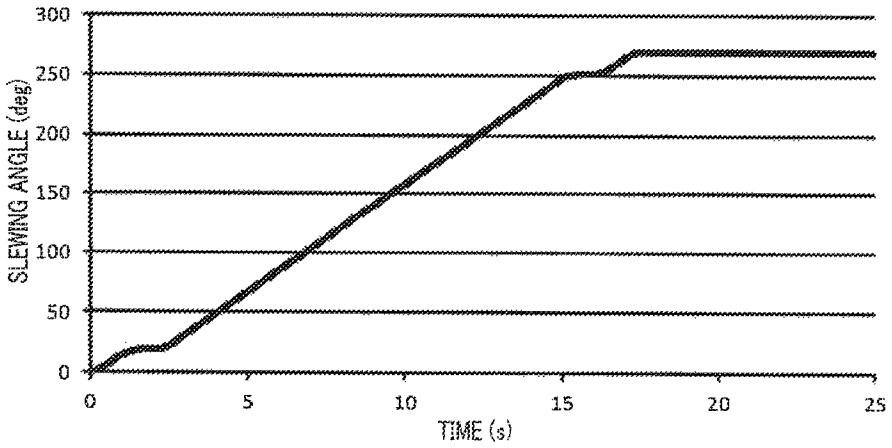
FIG. 5A illustrates exemplary transition of the slewing angle of the boom tip portion.
Figure 5B:
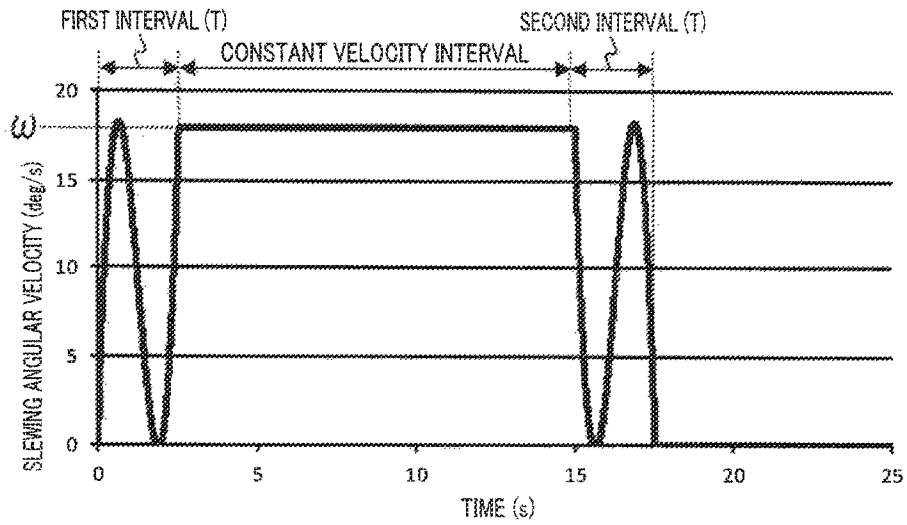
FIG. 5B illustrates exemplary transition of the slewing angular velocity of the boom tip portion.

Next, control section 50 determines a slewing angular velocity pattern (S12). The slewing angular velocity pattern represents transition of the angular velocity of the boom tip portion when upper working body 30 slews. As illustrated in FIG. 5B, the slewing angular velocity pattern includes a first interval of a control time T from the slewing start position until it reaches the slewing angular velocity ω, a constant velocity interval in which moving is performed constantly at the slewing angular velocity ω, and a second interval of the control time T from the slewing angular velocity ω until it stops at the slewing end position. The process of step S12 is an example of a slewing angular velocity pattern determination process.

In more detail, the boom tip portion is accelerated from a velocity 0 in the first interval of the control time, then decelerated, and then accelerated to reach the slewing angular velocity ω. In the below description, an angular velocity at the time of switching the velocity from acceleration to deceleration is referred to as a "maximum angular velocity", and an angular velocity at the time of switching the velocity from deceleration to acceleration is referred to as a "minimum angular velocity". In the example of FIG. 5B, the maximum angular velocity is ω, and the minimum angular velocity is 0. Then, in the slewing angular velocity pattern in the first interval, a difference between the maximum angular velocity and the minimum angular velocity increases as the control time T is shorter. In other words, the boom tip portion in the first interval is rapidly accelerated, rapidly decelerated, and rapidly accelerated, as the control time T is shorter.

The control time T is determined as described below, for example. First, control section 50 considers rope 38, hook 33, and suspended load 40, extending from the boom tip portion, as a pendulum, and calculates a cycle $T_0$ of the pendulum according to equation 1. Next, control section 50 calculates the control time T ($=T_0 \times \alpha$) by multiplying the cycle $T_0$ by a coefficient α ($\alpha<1$). The coefficient α is a value determined according to the response performance of slewing motor 31, for example. Specifically, the coefficient α may be decreased within a range that slewing motor 31 can follow the slewing angular velocity pattern when the coefficient α is decreased (that is, the control time T is shortened). In the present embodiment, the coefficient $\alpha=0.4$.

(Equation 1)

$$T_0 = 2\pi\sqrt{\frac{l}{g}} \quad [1]$$

Further, the slewing angular velocity pattern in the second interval is in rotational symmetry with the slewing angular velocity pattern of the first interval, for example. Specifically, in the second interval of the control time T, the boom tip portion is decelerated from the slewing angular velocity ω, then accelerated, then decelerated, and then stops at the slewing end position. Hereinafter, a procedure of determining the slewing angular velocity pattern of the first interval will be described in detail.

Figure 6:
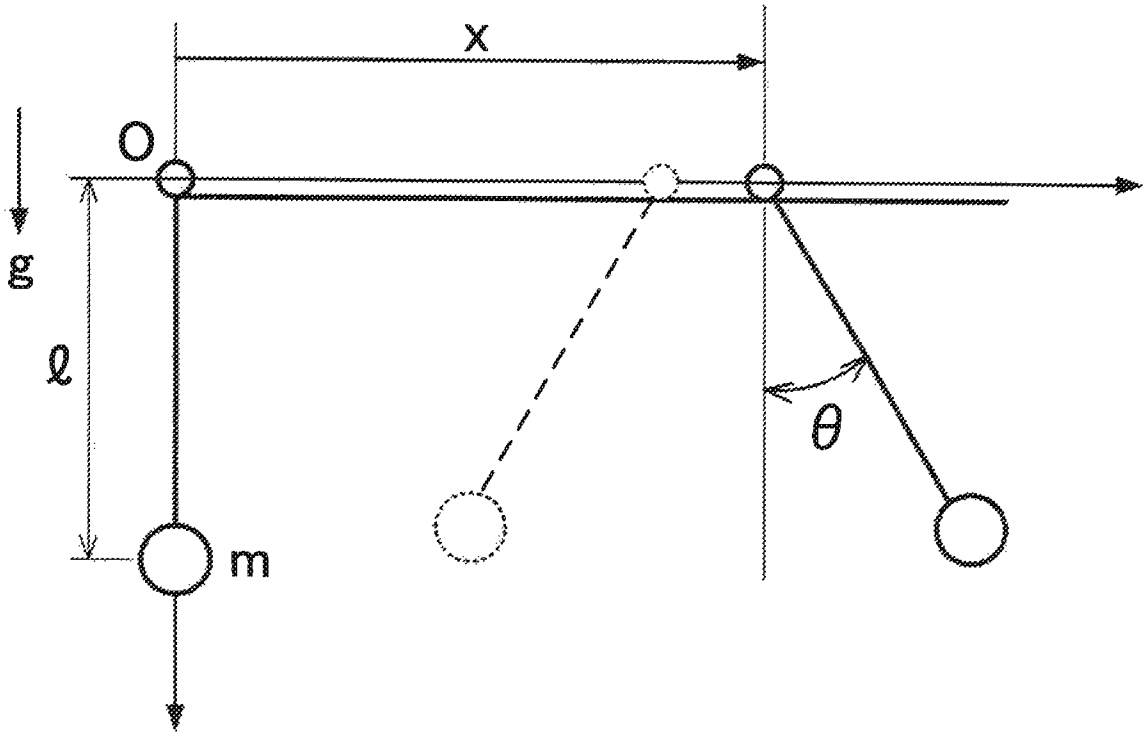
FIG. 6 illustrates a crane model for determining a slewing angular velocity pattern.

First, control section 50 analytically derives a moving locus of the boom tip portion in the slewing direction with use of a crane model illustrated in FIG. 6. In FIG. 6, x represents a position of the boom tip portion moving from the initial position O (that is, position of the boom tip portion corresponding to the slewing start position). θ represents an angle (hereinafter referred to as a "pendulum angle") between rope 38 extending from the boom tip portion at the position x and the vertical direction. g represents gravitational acceleration. An equation of motion of the crane model illustrated in FIG. 6 is expressed by equation 2 provided below. Further, equation 3 is established by linearize equation 2.

[2]

$$l\ddot{\theta}+g\sin\theta+\ddot{x}\cos\theta=0 \quad \text{(Equation 2)}$$

[3]

$$l\ddot{\theta}+g\theta+\ddot{x}=0 \quad \text{(Equation 3)}$$

Next, with use of equation 3 as a control target, a locus of the boom tip portion in the slewing direction is designed by using an evaluation function of the optimum control theory expressed by equation 4. Specifically, by extending equation 4 by Lagrange multiplier method so as to include equation 3 as a constrain condition, equation 5 is established. Further, an integrand $F_1'$, when a functional $J_1$ is minimized, satisfies equation 6. Then, by solving it, equation 7 is obtained.

(Equation 4)

$$J_1 = \int_0^T \frac{1}{2}\ddot{x}^2 dt \quad [4]$$

(Equation 5)

$$J_1' = \int_0^T F_1' dt \quad [5]$$

$$F_1' = \frac{1}{2}\ddot{x}^2 + \lambda_1(l\ddot{\theta} + g\theta + \ddot{x})$$

(Equation 6)

$$\frac{\partial F_1'}{\partial z_1} - \frac{d}{dt}\left(\frac{\partial F_1'}{\partial \dot{z}_1}\right) + \frac{d^2}{dt^2}\left(\frac{\partial F_1'}{\partial \ddot{z}_1}\right) = 0 \quad [6]$$

$$z_1 = \{x, \theta, \lambda_1\}$$

-continued (Equation 7)

$$\dot{x}(t) = \frac{-\alpha_1 l\sin\omega_n t + \alpha_2 l\cos\omega_n t}{\omega_n} + 0.5\alpha_3 lt^2 + \alpha_4 lt + \alpha_5 \quad [7]$$

$$\omega_n = \sqrt{\frac{g}{l}}$$

Here, $\lambda_1$ of equation 5 represents an undefined multiplier of Lagrange. Further, a constant $a_i$ (i=1, . . . , 5) of equation 7 is specified when being applied with the initial condition and the terminal condition expressed in equation 8. Specifically, when equation 6 in which $z_1$ is substituted with x is solved for x, x', equation 6 in which $z_1$ is substituted with θ is solved for θ, θ', and equation 6 in which $z_1$ is substituted with $\lambda_1$ is solved for $\lambda_1$, five equations including undefined constants $a_1$ to $a_5$ obtained in the process of integration are obtained. By assigning the respective conditions of equation 8 to the obtained five equations to solve the simultaneous equations, the constants $a_1$ to $a_5$ are specified. For example, in the slewing angular velocity pattern illustrated in FIG. 5B, $a_1$=0.6609, $a_2$=2.034, $a_3$=0, $a_4$=1.743, and $a_5$=−20.53, for example. Further, $R_0(T)$ represents a slewing radius after T seconds from the start of slewing, which is calculated from equation 9.

(Equation 8)

initial condition [8]

$$x(0) = 0,\ \dot{x}(0) = 0,\ \theta(0) = 0,\ \dot{\theta} = 0$$

terminal condition $$\dot{x}(T) = R_0(T)\cdot\omega,\ \theta(T) = 0,\ \dot{\theta}(T) = 0$$

$$\left[\frac{\partial F'}{\partial \dot{x}} - \frac{d}{dt}\left(\frac{\partial F'}{\partial \ddot{x}}\right)\right]_{t=T} = 0$$

[Radial Velocity Pattern Determination Process]

Next, control section 50 determines a radial velocity pattern (S13). The radial velocity pattern shows transition of the moving velocity in the slewing radius direction of the boom tip portion when upper working body 30 slews from the slewing start position to the slewing end position. According to an example of a radial velocity pattern illustrated in FIG. 7B, the boom tip portion in the first interval is moved in a direction of increasing the slewing radius, and then, moved in a direction of decreasing the slewing radius. Meanwhile, the boom tip portion in the constant velocity interval is not moved in the slewing radius direction. The radial velocity pattern in the second interval is in rotational symmetric to the radial velocity pattern in the first interval. The process of step S13 is an example of a radial velocity pattern determination process.

In more detail, the boom tip portion in the first interval is moved from the position of the slewing radius r at the moving start position in a direction of increasing the slewing radius, and then, moved in a direction of decreasing the slewing radius, and then reaches the position of a target slewing radius r', described below, at the end of the first interval. The radial velocity pattern in the first interval defines a moving pattern of the boom tip portion for balancing forces in the slewing radius direction (that is, centrifugal force and a horizontal component of the tensile force of rope 38) acted on suspended load 40 at the position of the slewing radius r, at the end of the first interval.

Figure 9:
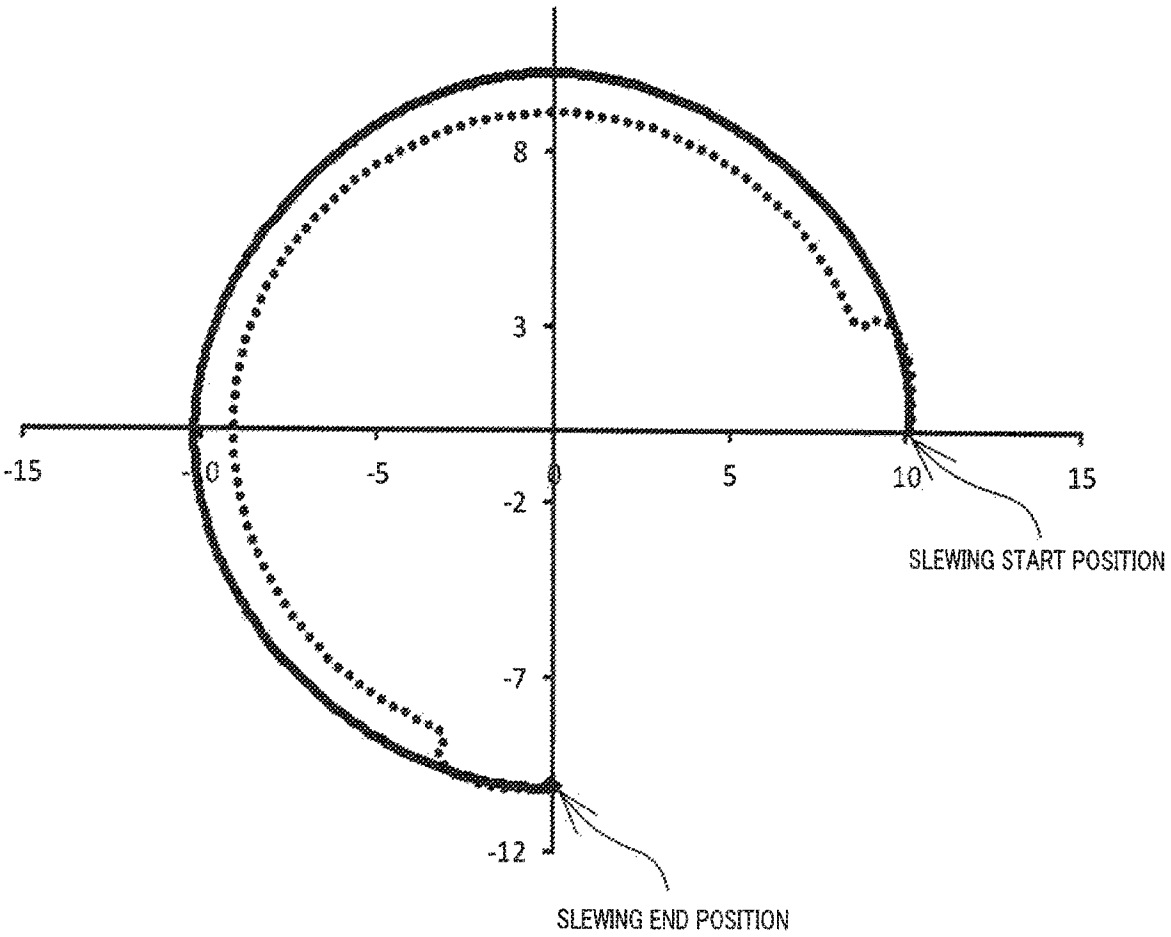
FIG. 9 illustrates a positional relationship between the boom tip portion and suspended load 40 in a slewing control process.

Meanwhile, the boom tip portion in the constant velocity interval is not moved in the slewing radius direction from the target slewing radius r'. Specifically, the magnitude of the horizontal component of the tensile force of rope 38 acted on suspended load 40 is not changed in the constant velocity interval. As the slewing angular velocity ω of suspended load 40 in the constant velocity interval is constant, the centrifugal force acted on suspended load 40 is not changed either. Consequently, suspended load 40 in the constant velocity interval moves on the position of the slewing radius r in a state where the forces in the slewing radial direction are balanced, as illustrated in FIG. 9 by a solid line.

Further, the boom tip portion in the second interval is moved from the position of the target slewing radius r' up to a position where the slewing radius is greater than that at the position of the slewing radius r, and then, moved in a direction of decreasing the slewing radius, and reaches the position of the slewing radius r at the end of the second interval (that is, moving end position). The radial velocity pattern in the second interval defines a moving pattern of the boom tip portion for causing the forces in the slewing radial direction (that is, centrifugal force, and the horizontal component of the tensile force of rope 38) to be zero in suspended load 40 at the position of the slewing radius r, at the end of the second interval.

The target slewing radius r' is determined as described below, for example. In the crane model of FIG. 8, the target slewing radius r' for balancing the forces in the slewing radial direction acted on suspended load 40 at the position of the slewing radius r is calculated by equation 9, for example. Further, φe in equation 9 represents a pendulum angle at the end of the first interval, which is calculated by equation 10.

(Equation 9)

$$r' = r - l\sin\phi_e \quad [9]$$

(Equation 10)

$$\phi_e = \tan^{-1}\left(\frac{r\omega^2}{g}\right) \quad [10]$$

Then, control section 50 sets $R_0(t)$, representing transition of the slewing radius in the first interval, as a fifth function as expressed by equation 11. Then, by differentiating $R_0(t)$, a radial velocity pattern expressed by equation 12 is obtained.

[11]

$$R_0(t)=r_0+r_1t+r_2t^2+r_4t^4+r_5t^5 \quad \text{(Equation 11)}$$

[12]

$$R'_0(t)=r_1+2r_2t+3r_3t^2+4r_4t^3+5r_5t^4 \quad \text{(Equation 12)}$$

It should be noted that the constant $r_i$ (i=0, . . . , 5) in equations 11 and 12 is specified by applying the initial condition, the boundary condition, and the terminal condition of equation 13. Specifically, it is only necessary to solve simultaneous equations by applying the respective conditions of equation 13 to equations 11 and 12. For example, in the radial velocity pattern illustrated in FIG. 7B, $r_0$=10.08, $r_1$=0, $r_2$=1.355, $r_3$=−1.770, $r_4$=0.6424, and $r_5$=−0.07070.

[13]

initial condition $$R_0(0)=r, \dot{R}_0(0)=0$$

boundary condition $$R_0(0.3T)r+0.2l\sin\phi_e, \dot{R}_0(0.3T)=0$$

terminal condition $$R_0(T)=r-l\sin\phi_e, \dot{R}_0(T)=0 \quad \text{(Equation 13)}$$

[Actuator Control Process]

Next, control section 50 drives slewing motor 31 according to the determined slewing angular velocity pattern. Control section 50 also drives derricking cylinder 35 and/or the telescopic cylinder 36 according to the determined radial velocity pattern (S14). The process of step S14 is an example of an actuator control process.

Specifically, control section 50 controls slewing motor 31 to allow upper working body 30 to slew from the slewing start position to the slewing end position such that the boom tip portion moves in the slewing direction at an angular velocity indicated by a slewing angular velocity pattern. FIG. 5A illustrates transition of the slewing angle at the boom tip portion that moves according to the slewing angular velocity pattern illustrated in FIG. 5B.

Figure 7A:
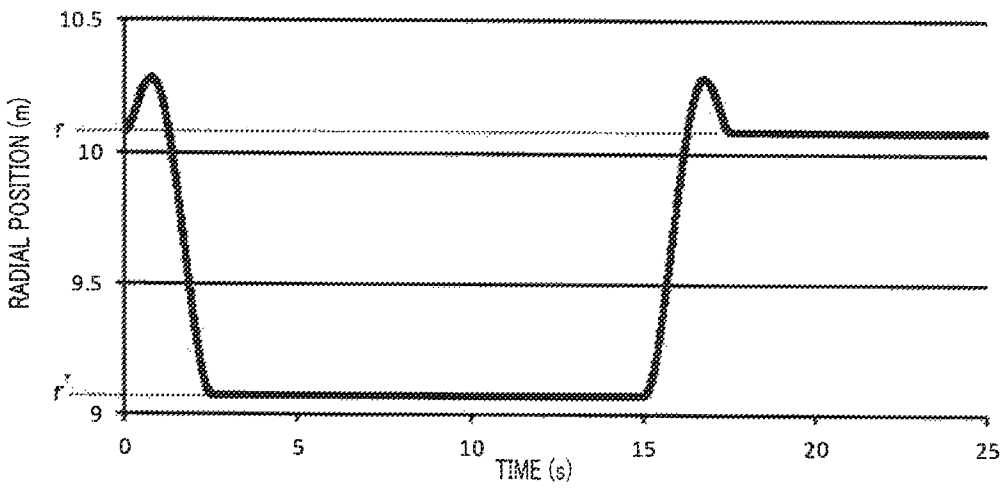
FIG. 7A illustrates exemplary transition of a radial position of the boom tip portion.

Control section 50 also controls derricking cylinder 35 and/or telescopic cylinder 36 to allow telescopic boom 32 to be derricked and/or telescoped such that the boom tip portion moves in the slewing radial direction at a velocity shown by the radial velocity pattern. FIG. 7A illustrates transition of the position in the slewing radial direction of the boom tip portion that moves according to the radial velocity pattern illustrated in FIG. 7B.

It should be noted that control section 50 may realize movement of the boom tip portion according to the radial velocity pattern by one of derricking cylinder 35 and telescopic cylinder 36, or may be realized by both derricking cylinder 35 and telescopic cylinder 36. For example, control section 50 may select an actuator to be used for realizing the radial velocity pattern according to the derricking angle of telescopic boom 32 at the slewing start position.

When the derricking angle of telescopic boom 32 is smaller than a first threshold, control section 50 may control operation in the slewing radial direction by only using telescopic cylinder 36. Further, when the derricking angle of telescopic boom 32 is equal to or larger than the first threshold but smaller than a second threshold, control section 50 may control operation in the slewing radial direction by linking derricking cylinder 35 and telescopic cylinder 36. Furthermore, when the derricking angle of telescopic boom 32 is equal to or larger than the second threshold, control section 50 may control operation in the slewing radial direction by only using derricking cylinder 35. It should be noted that the second threshold is larger than the first threshold. For example, it is acceptable that first threshold=30° and second threshold=60°.

When attempting to realize the radial velocity pattern by using both derricking cylinder 35 and telescopic cylinder 36, control section 50 may resolve the radial velocity pattern into a derricking velocity and a telescopic velocity. Then, control section 50 may drive derricking cylinder 35 according to the derricking velocity, and drive telescopic cylinder 36 according to the telescopic velocity.

[Action and Effect of Embodiment]

Figure 7B:
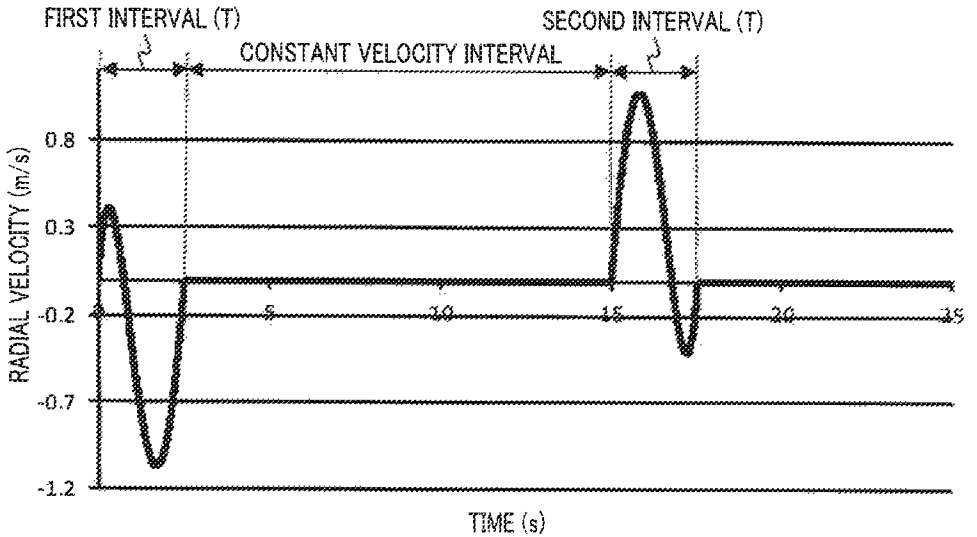
FIG. 7B illustrates exemplary transition of a radial velocity of the boom tip portion.
Figure 8:
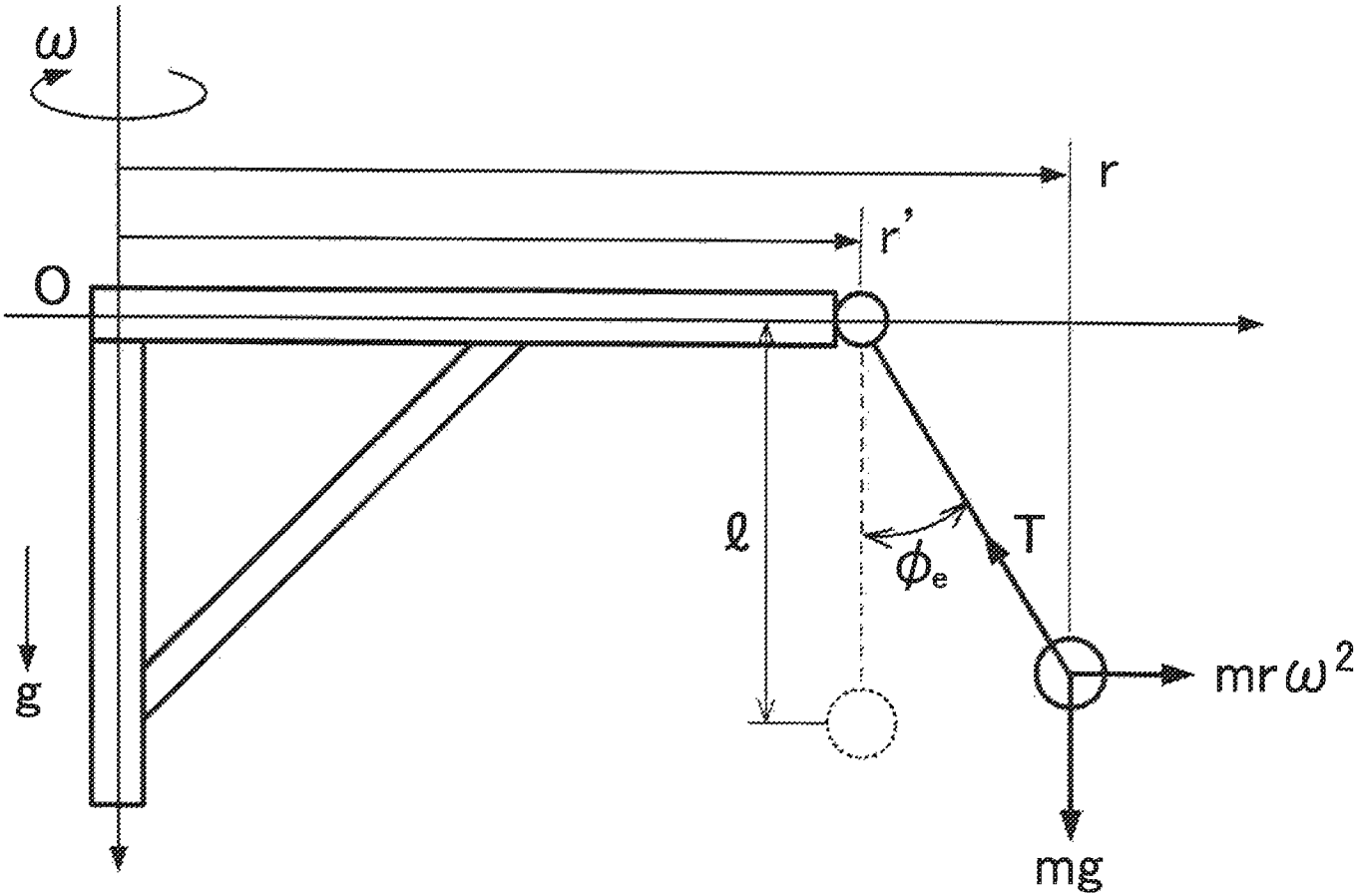
FIG. 8 illustrates a crane model for determining a radial velocity pattern.

FIG. 9 illustrates a positional relationship in the slewing radial direction between the boom tip portion and suspended load 40 when the boom tip portion is moved according to the slewing angular velocity pattern illustrated in FIG. 5B and the radial velocity pattern illustrated in FIG. 7B. Suspended load 40 illustrated by a solid line in FIG. 9 moves on the circumference of the slewing radius r. Meanwhile, the position of the boom tip portion illustrated by a dotted line in FIG. 9 moves on the circumference of the target slewing radius r' that is smaller than the slewing radius r in the constant velocity interval. Then, the position of the boom tip portion in the slewing radial direction overlaps the position of suspended load 40 in the slewing radial direction at the start of the first interval and the end of the second interval.

Figure 10A:
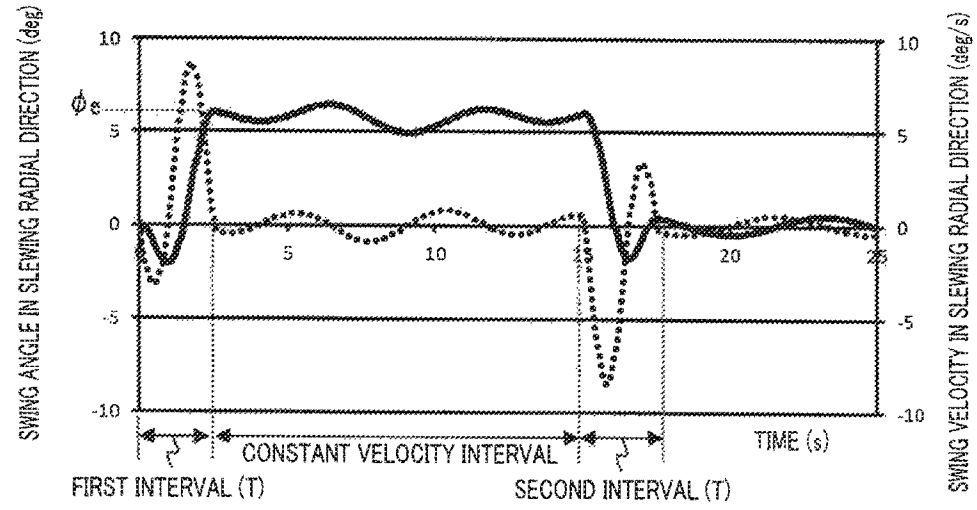
Figure 10B:
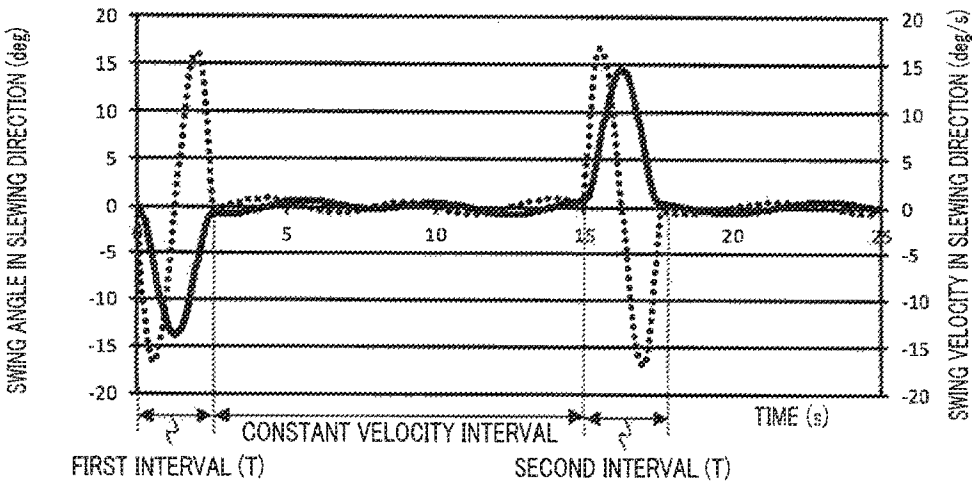

FIG. 10A illustrates a relationship between the swing angle (solid line) of suspended load 40 in the slewing radial direction and the swing velocity (dotted line) of suspended load 40 in the slewing radial direction, and FIG. 10B illustrates a relationship between the swing angle (solid line) of suspended load 40 in the slewing direction and the swing velocity (dotted line) of suspended load 40 in the slewing direction, when the boom tip portion is moved according to the slewing angular velocity pattern illustrated in FIG. 5B and the radial velocity pattern illustrated in FIG. 7B. It should be noted that the swing angle indicates an angle defined by the vertical direction and rope 38. Further, the swing velocity indicates a relative velocity (velocity difference) to the velocity of the boom tip portion.

As illustrated in FIG. 10A, suspended load 40 in the first interval and the second interval swings in the slewing radial direction when the boom tip portion is moved in the slewing radial direction according to the radial velocity pattern. Then, at the end of the first interval, the swing velocity of suspended load 40 in the slewing radial direction converges to almost zero, and the swing angle of suspended load 40 in the slewing radial direction converges to almost φe. In the constant velocity interval, the swing velocity of suspended load 40 in the slewing radial direction is stable at almost zero, and the swing angle of suspended load 40 in the slewing radial direction is stable at almost φe. Then, at the end of the second interval, the swing velocity of suspended load 40 in the slewing radial direction converges to almost zero, and the swing angle of suspended load 40 in the slewing radial direction converges to almost zero.

As illustrated in FIG. 10B, in the first interval and the second interval, suspended load 40 swings in the slewing direction when the boom tip portion is moved in the slewing direction according to the slewing angular velocity pattern. Then, at the end of the first interval and at the end of the second interval, the swing velocity of suspended load 40 in the slewing direction converges to almost zero, and the swing angle of suspended load 40 in the slewing direction converges to almost zero. Further, in the constant velocity interval, the swing velocity of suspended load 40 in the slewing direction is stable at almost zero, and the swing angle of suspended load 40 in the slewing direction is stable at almost zero.

As described above, according to the aforementioned embodiment, it is possible to suppress not only the swing of suspended load 40 in the slewing direction at the slewing end position but also the swing of suspended load 40 in the slewing radial direction. Consequently, when telescopic boom 32 is allowed to slew in a narrow space in particular, it is possible to suppress suspended load 40, pushed out by the centrifugal force, from being brought into contact with an obstacle.

Further, according to the aforementioned embodiment, the control time T of the first interval and the second interval can be reduced from the cycle $T_0$ of suspended load 40 performing pendulum motion within a range of response performance of slewing motor 31. Consequently, the slewing time from the slewing start position to the slewing end position can be reduced. It should be noted that in the slewing angular velocity pattern, the constant velocity interval is not indispensable, and may be omitted.

Figure 11:
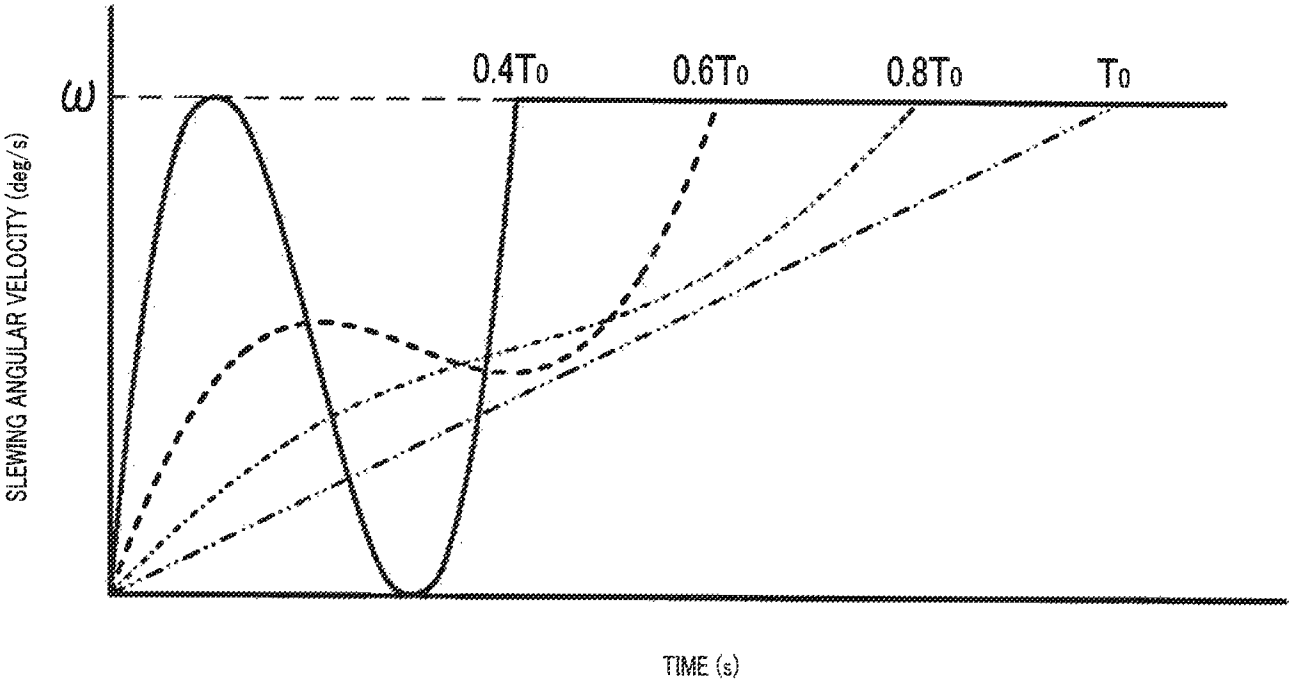
FIG. 11 illustrates a relationship between a coefficient $\alpha$ by which a cycle $T_0$ for calculating a control time T is multiplied, and a slewing angular velocity pattern in a first interval.

FIG. 11 illustrates a relationship between the coefficient α for calculating the control time T and the slewing angular velocity pattern in the first interval. In FIG. 11, the slewing angular velocity pattern where α=0.4 (T=0.4 $T_0$) is illustrated by a solid line, the slewing angular velocity pattern where α=0.6 (T=0.6 $T_0$) is illustrated by a broken line, the slewing angular velocity pattern where α=0.8 (T=0.8 $T_0$) is illustrated by alternate long and short dashed lines, and the slewing angular velocity pattern where α=1 (T=$T_0$) is illustrated by alternate long and two short dashed lines.

As illustrated in FIG. 11, as the coefficient α is smaller, the control time T taken until the angular velocity ω is reached is shorter. Accordingly, from the viewpoint of reducing the slewing time from the slewing start position to the slewing end position, a smaller coefficient α value is desirable. On the other hand, as the value of coefficient α is smaller, a difference between the maximum angular velocity and the minimum angular velocity increases, whereby sudden acceleration and sudden deceleration are required. In other words, as the value of coefficient α is larger, a difference between the maximum angular velocity and the minimum angular velocity decreases, whereby the slewing angular velocity pattern where coefficient α=1 becomes a straight line (that is, uniformly accelerated motion).

Specifically, when the value of coefficient α is too small, even if control section 50 attempts to control slewing motor 41 according to the slewing angular velocity pattern, slewing motor 41 may not follow. As such, it is desirable to select a minimum coefficient α within the range of the response performance of slewing motor 41. It should be noted that the response performance of slewing motor 41 may also include the response performance of a valve and the like disposed on the oil passage for feeing hydraulic oil to slewing motor 41, in addition to the response performance itself of slewing motor 41.

Figure 12:
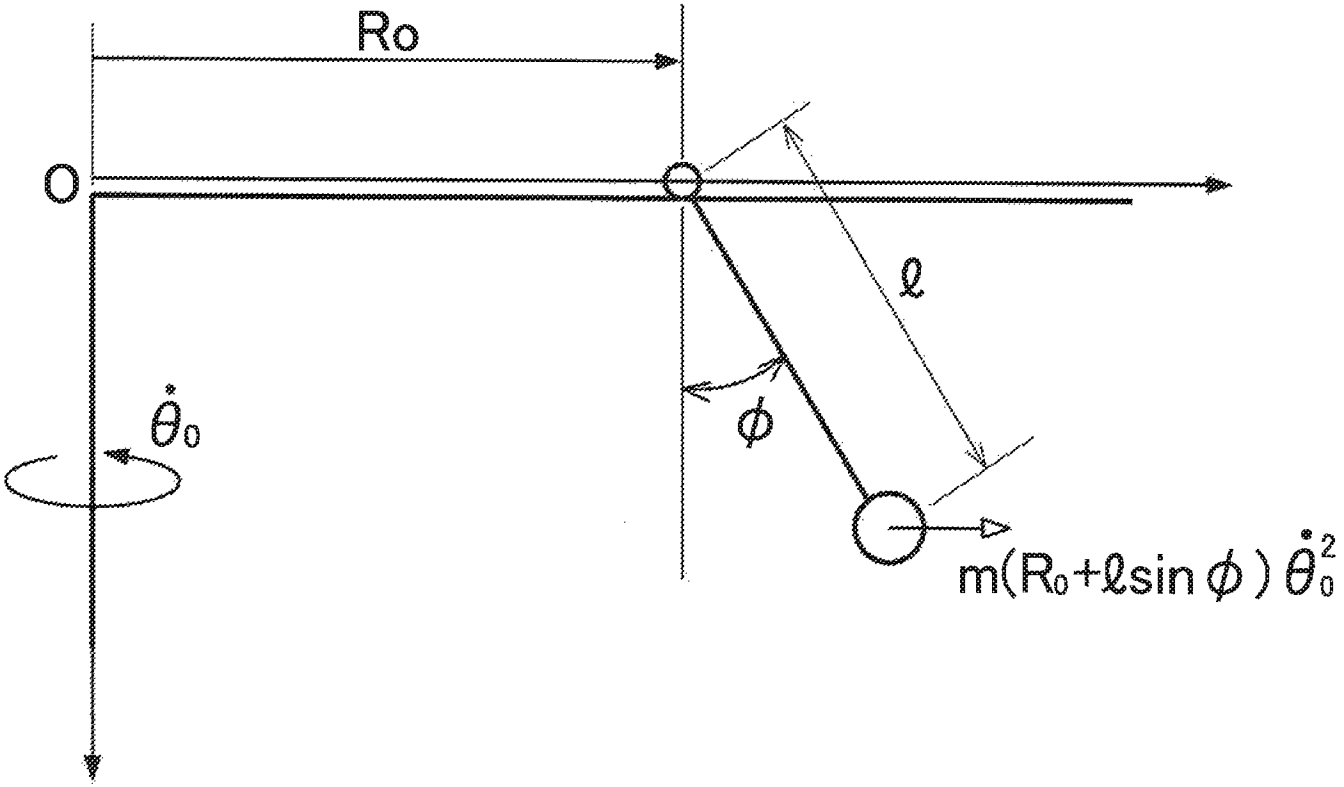
FIG. 12 illustrates a crane model for determining a radial velocity pattern.

While the aforementioned embodiment has described an example in which a radial velocity pattern is determined according to equation 12, the method of determining a radial velocity pattern is not limited to this. It may be determined by optimum control like a slewing angular velocity pattern. Specifically, the equation of motion of the crane model illustrated in FIG. 12 may be expressed as equation 14. Further, equation 15 is established by approximating equation 14. It should be noted that constant Ω in equation 15 corresponds to the slewing angular velocity of the centrifugal force term of equation 14.

[14]

$$l\ddot{\phi}+\ddot{R}_0 \cos \phi+g \sin \phi=(R_0+l \sin \phi)\theta_0^3 \cos \phi \quad \text{(Equation 14)}$$

[15]

$$l\ddot{\phi}+\ddot{R}_0+g\phi=(R_0+l\phi)\Omega^2 \quad \text{(Equation 15)}$$

Then, with use of equation 15 as a control target, a locus of the boom tip portion in the slewing radial direction is designed by using an evaluation function of the optimum control theory expressed by equation 16. Specifically, by extending equation 16 by Lagrange multiplier method so as to include equation 15 as a constrain condition, equation 17 is established. Further, an integrand $F_2'$, when a functional $J_2$ is minimized, satisfies equation 18. Then, by solving it, equation 19 is obtained.

(Equation 16)

$$J_2 = \int_0^T \frac{1}{2}\ddot{R}_0^2 dt \quad [16]$$

(Equation 17)

$$J_2' = \int_0^T F_2' dt \quad [17]$$

$$F_2' = \frac{1}{2}\ddot{R}_0^2 + \lambda_2\{l\ddot{\phi} + \ddot{R}_0 + g\phi - (R_0 + l\phi)\Omega^2\}$$

(Equation 18)

$$\frac{\partial F_2'}{\partial z_2} - \frac{d}{dt}\left(\frac{\partial F_2'}{\partial \dot{z}_2}\right) + \frac{d^2}{dt^2}\left(\frac{\partial F_2'}{\partial \ddot{z}_2}\right) = 0 \quad [18]$$

$$z_2 = \{R_0, \phi, \lambda_2\}$$

(Equation 19)

$$\dot{R}_0(t) = \frac{\left(1 + \frac{\Omega^2}{\omega_r^2}(b_1 \sin\omega_r t - b_2 \cos\omega_r t)\right)}{\omega_r} + 0.5b_3 t^2 + b_4 t + b_3 \quad [19]$$

$$\omega_r = \sqrt{\frac{l}{g} - \Omega^2}$$

Here, $\lambda_1$ of equation 17 is an undefined multiplier of Lagrange. Further, a constant $b_i$ (i=1, . . . , 5) of equation 19 is specified when being applied with the initial condition and the terminal condition expressed in equation 20. Specifically, when equation 18 in which $z_2$ is substituted with $R_0$ is solved for $R_0$, $R_0'$, equation 18 in which $z_2$ is substituted with $\varphi$ is solved for $\varphi$,$\varphi'$, and equation 18 in which $z_2$ is substituted with $\lambda_2$ is solved for $\lambda_2$, five equations including undefined constants $b_1$ to $b_5$, obtained in the process of integration, are established. By assigning the respective conditions of equation 20 to the established five equations to solve the simultaneous equations, the constants $b_1$ to $b_5$ are specified. For example, in the radial velocity pattern illustrated in FIG. 7B, $b_1$=46.22, $b_2$=−104.8, $b_3$=96.34, $b_4$=−119.0, and $b_5$=−50.62, for example. Further, constant $\Omega$ is a value derived by trial and error in order to obtain a preferable radial velocity pattern. For example, in the radial velocity pattern illustrated in FIG. 7B, $\Omega$=1.5 rpm.

[20]

initial condition $$R_0(0)=r, \dot{R}_0(0)=0, \phi(0)=0, \dot{\phi}(0)=0$$

terminal condition $$R_0(T)=r-l \sin \phi_e, \dot{R}_0(T)=0, \phi(T)=\varphi_e, \dot{\phi}(T)=0 \quad \text{(Equation 20)}$$

REFERENCE SIGNS LIST

10 Rough terrain crane
20 Lower traveling body
30 Upper working body
31 Slewing motor
32 Telescopic boom
33 Rope
36 Derricking cylinder
37 Telescopic cylinder
38 Rope
50 Control section
51 Slewing angle sensor
52 Derricking angle sensor
53 Boom length sensor
54 Rope length sensor
55 Suspended load weight sensor
56 Operation section

The invention claimed is:

1. A slewing apparatus comprising:

a control section that controls a slewing actuator that allows a slewing body to slew, the slewing body supporting a boom in a derricking and telescopic manner, wherein the control section performs:

an acquisition process of acquiring a slewing start position and a slewing end position of the slewing body, and a pendulum length that is a length from a tip portion of the boom to a suspended load suspended from a hook;

a slewing angular velocity pattern determination process of determining a slewing angular velocity pattern by optimum control in a first interval and a second interval, the slewing angular velocity pattern indicating transition of an angular velocity of the tip portion of the boom when the slewing body slews from the slewing start position to the slewing end position, the first interval being an interval in which the angular velocity is accelerated from the slewing start position, and decelerated, and accelerated to be a slewing angular velocity $\omega$, the second interval being an interval in which the angular velocity is decelerated from the slewing angular velocity $\omega$, and accelerated, and decelerated to be stopped at the slewing end position; and an actuator control process of controlling the slewing actuator to allow the slewing body to slew from the slewing start position to the slewing end position such that the tip portion of the boom moves in a slewing direction at a velocity indicated by the slewing angular velocity pattern, and in the slewing angular velocity pattern determination process, the slewing angular velocity pattern is determined such that in the first interval and the second interval of a control time T that is shorter than a cycle determined by the pendulum length of the suspended load that is in a pendulum motion, a difference between a maximum angular velocity and a minimum angular velocity increases as the control time T decreases.

2. The slewing apparatus according to claim 1, wherein in the slewing angular velocity pattern determination process, the control section determines the slewing angular velocity pattern in which the control time T is shortest within a range of response performance of the slewing actuator.

3. The slewing apparatus according to claim 1, wherein in the slewing angular velocity pattern determination process, the control section determines an angular velocity x'(t) of the tip portion of the boom after t second from start of slewing by specifying a coefficient $\alpha_i$ (i=1, . . . , 5) satisfying an initial condition and a terminal condition of the first interval in the following equation 1:

(Equation 1)

$$\dot{x}(t) = \frac{-\alpha_1 l \sin\omega_n t + \alpha_2 l \cos\omega_n t}{\omega_n} + 0.5\alpha_3 l t^2 + \alpha_4 l t + \alpha_5$$

$$\omega_n = \sqrt{\frac{g}{l}}.$$

wherein ω is the slewing angular velocity,
g is gravitational acceleration, and
l is the pendulum length.

4. The slewing apparatus according to claim 1, further comprising:

a derricking actuator that derricks the boom under control of the control section; and a telescopic actuator that telescopes the boom under control of the control section; wherein the control section further performs a radial velocity pattern determination process of determining a radial velocity pattern, the radial velocity pattern indicating transition of a moving velocity of the tip end portion of the boom in a slewing radial direction when the slewing body slews from the slewing start position to the slewing end position, wherein in the radial velocity pattern, the slewing radius is increased and decreased in the first interval and the second interval, in the acquisition process, the control section further acquires a slewing radius r, the slewing radius r being a horizontal distance between center of slewing of the slewing body and the tip portion of the boom at the slewing start position, in the radial velocity pattern determination process, the control section determines the radial velocity pattern in which forces in the slewing radial direction acted on the suspended load at a position of the slewing radius r at end of the first interval and at end of the second interval are balanced, and in the actuator control process, the control section controls the derricking actuator and/or telescopic actuator to allow the boom to be derricked and/or telescoped such that the tip portion of the boom moves in the slewing radial direction at a velocity indicated by the radial velocity pattern.

5. The slewing apparatus according to claim 4, wherein in the radial velocity pattern determination process, the control section determines the radial velocity pattern in which the suspended load moves on the slewing radius r when the slewing body slews from the slewing start position to the slewing end position.

6. The slewing apparatus according to claim 4, wherein in the radial velocity pattern determination process, the control section determines a moving velocity $R_0'(t)$ in the slewing radial direction of the tip portion of the boom after t second from start of slewing by specifying a coefficient $r_i$ (i=0, . . . , 5) satisfying an initial condition and a terminal condition of the first interval in the following equation 2:

$$R'_0(t)=r_1+2r_2t+3r_3t^2+4r_4t^3+5r_5t^4 \quad \text{(Equation 2).}$$

7. The slewing apparatus according to claim 4, wherein in the radial velocity pattern determination process, the control section determines a moving velocity $R_0'(t)$ in the slewing radial direction of the tip portion of the boom after t second from start of slewing by specifying a coefficient $b_i$ (i=1, . . . , 5) satisfying an initial condition and a terminal condition of the first interval in the following equation 3:

(Equation 3)

$$\dot{R}_0(t) = \frac{\left(1 + \frac{\Omega^2}{\omega_r^2}\right)(b_1 \sin\omega_r t - b_2 \cos\omega_r t)}{\omega_r} + 0.5 b_3 t^2 + b_4 t + b_5$$

$$\omega_r = \sqrt{\frac{l}{g} - \Omega^2},$$

wherein ω is the slewing angular velocity,
g is gravitational acceleration,
l is the pendulum length, and
Ω is a constant value derived by trial and error in order to obtain a preferable radial velocity pattern.

* * * * *